US005441184A

United States Patent [19]

Durso

[11] Patent Number: 5,441,184

[45] Date of Patent: Aug. 15, 1995

[54] SKI SEAT AND CARRIER

[76] Inventor: Joe Durso, 514 Lowewood Pl., Chula Vista, Calif. 91910

[21] Appl. No.: 160,739

[22] Filed: Dec. 3, 1993

[51] Int. Cl.[6] ..... A63C 11/00

[52] U.S. Cl. ..... 224/151; 224/917; 280/812

[58] Field of Search ..... 224/151, 917, 224, 185; 280/812, 814, 816; 297/129

[56] References Cited

U.S. PATENT DOCUMENTS

| | | | |
|---|---|---|---|
| 2,530,695 | 11/1950 | Helmert | 224/151 |
| 4,456,284 | 6/1984 | Saka | 224/917 |

FOREIGN PATENT DOCUMENTS

| | | | |
|---|---|---|---|
| 320464 | 6/1989 | European Pat. Off. | 280/812 |
| 2635808 | 2/1978 | Germany | 280/812 |

*Primary Examiner*—Renee S. Luebke
*Attorney, Agent, or Firm*—Harry M. Cross, Jr.

[57] ABSTRACT

A ski seat and carrier comprises a generally rectangular seat panel, with provision at the top of the seat panel for attaching the seat panel to a pair of skis for suspending the seat panel between a pair of skis, and with provision at the bottom of the seat panel for receiving a ski pole for suspending the bottom of the seat panel between a pair of skis so that the seat panel can provide a sling-type seat for a skier when suspended between a pair of skis. A pocket is provided extending across the bottom of the seat panel. The pocket has a closed bottom end and closed side ends and provides a compartment having a depth substantially less than the length of the seat panel and a width extending substantially across the width of the seat panel. The pocket has an opening extending substantially across the width of the seat panel so that the compartment opens toward the end of the seat panel that is opposite the seat panel's bottom end. The pocket is so constructed and arranged with respect to the seat panel that, when the seat panel is folded onto itself into a series of transverse folds, the compartment may be turned inside out to envelope the folded-up seat panel.

5 Claims, 3 Drawing Sheets

SKI SEAT AND CARRIER

FIELD OF THE INVENTION

This invention relates to portable seats adapted to be suspended between two snow skis and to compact ski carriers.

BACKGROUND OF THE INVENTION

Portable ski seats of the type made up of a flexible panel designed to be suspended between two snow skis have been proposed heretofore. Such seats provide means for suspending the top of the flexible panel from the tips of skis that have been planted in snow, and for suspending the bottom of the flexible panel from the skis' bindings by means of a ski pole inserted through a slot in the bottom of the panel. The seat panel is longer than the distance between the ski tip and the ski binding and thus, in combination with the skis, provides a sling-type reclining chair.

These seats, even when their panels are fabricated from thin fabric material, are somewhat bulky and can be a nuisance to carry around while skiing when not in use.

SUMMARY OF THE INVENTION

The ski seat and ski carrier of this invention provides a sling-type seat that, in function, is similar to the ski seats heretofore proposed as described above. However, the ski seat and carrier of this invention also is designed to be used to carry a pair of skis and ski poles, and when not in use as a ski seat or a ski carrier, is designed to be worn or carried around the skier's waist. The ski seat and carrier of this invention is comprised of a flexible panel of generally rectangular shape. This panel is provided with means at its top end for attachment to the tips of a pair of skis. Means providing a slot at the bottom of the panel permit a ski pole to be inserted through the slot so that the ends of the pole may be rested on the ski bindings. Compartment means provided at the bottom of the panel provides a pocket which contains a waist belt for attachment around a skier's waist. The compartment means are so constructed that the pocket can be reversed so that the seat panel may be inserted into the pocket of the compartment and so that the waist belt is exposed to permit the seat to be strapped around the skier's waist. The panel is also provided with means that permit the panel to be used as a sling to carry the skier's skis and poles.

In summary, then, the ski seat and carrier of this invention comprises a generally rectangular seat panel, means at the top of the seat panel for attaching the seat panel to a pair of skis for suspending the seat panel between a pair of skis, and means at the bottom of the seat panel for receiving a ski pole for suspending the bottom of the seat panel between a pair of skis whereby the seat panel can provide a sling-type seat for a skier when suspended between a pair of skis. Pocket means providing a pocket extending across the bottom of the seat panel are provided. The pocket has a closed bottom end and closed side ends and provides a compartment having a depth substantially less than the length of the seat panel and a width extending substantially across the width of the seat panel. The pocket has an opening extending substantially across the width of the seat panel so that the compartment opens toward the end of the seat panel that is opposite the seat panel's bottom end. The pocket means is so constructed and arranged with respect to the seat panel that, when the seat panel is folded onto itself into a series of transverse folds, the compartment may be turned inside out to envelope the folded-up seat panel.

DETAILED DESCRIPTION OF THE INVENTION

Figure 1:
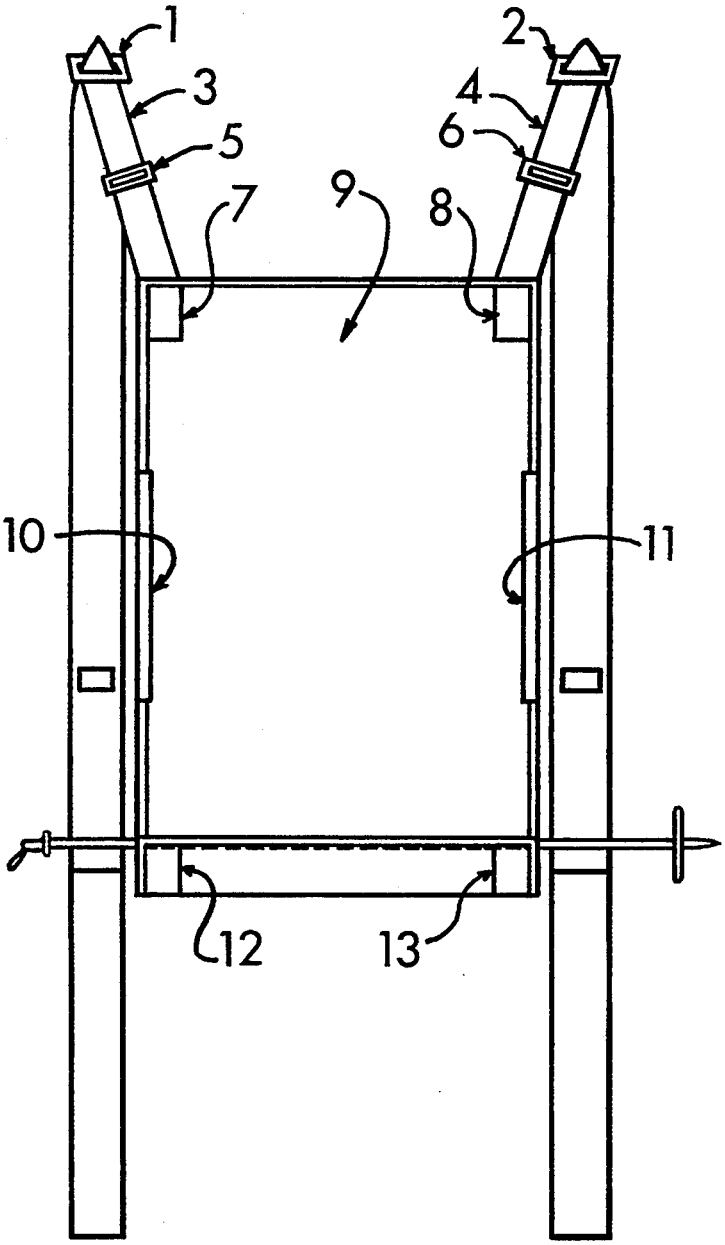
FIG. 1 is a front view in elevation illustrating the seat panel of the seat and ski carrier of this invention carried by a pair of upright skis, as would be the case if the skis were stuck into the snow, showing its use as a ski seat.
Figure 2:
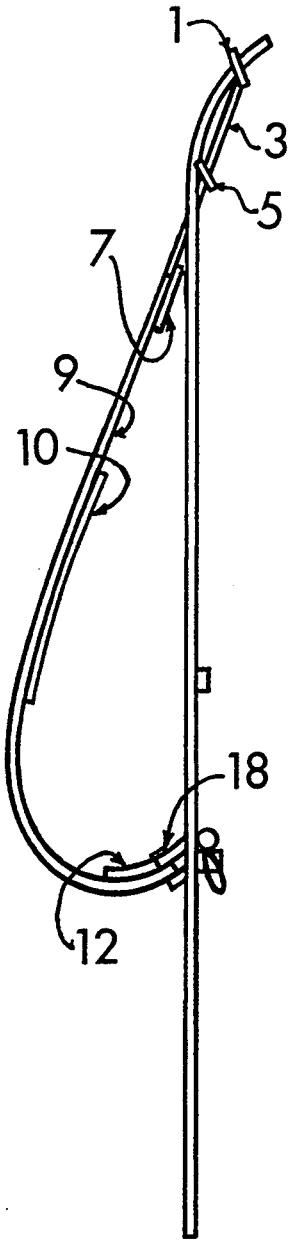
FIG. 2 is a side view in elevation of the FIG. 1 assembly.
Figure 3:
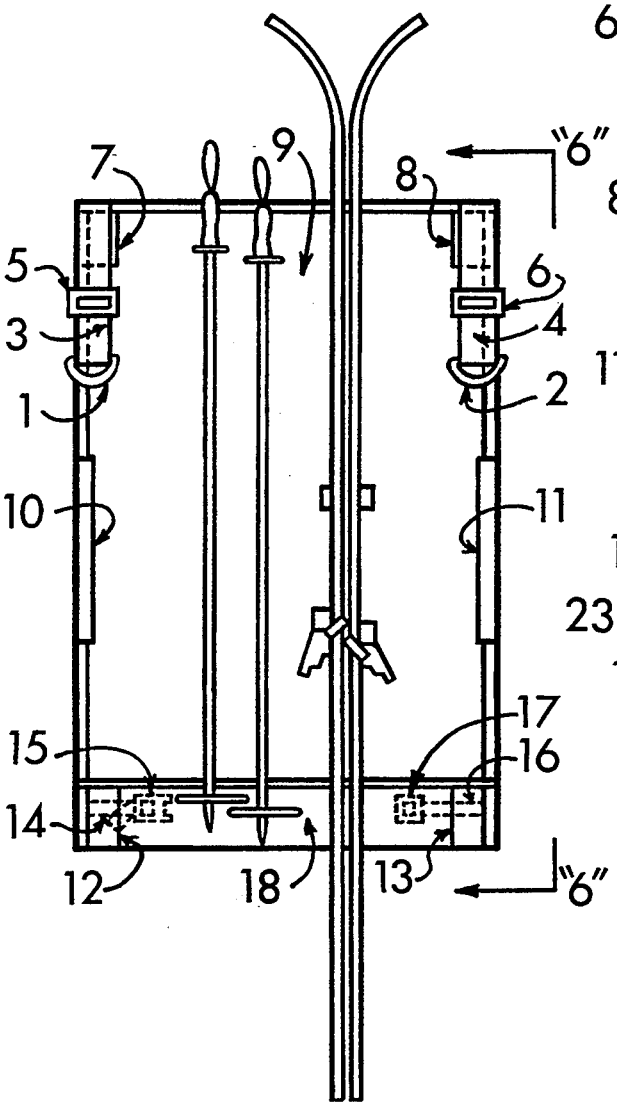
FIG. 3 is a plan view of the ski seat and ski carrier with the seat panel laid out and the skier's skis and poles placed on the seat panel, as would be the case if it was to be used as a ski carrier.
Figure 5:
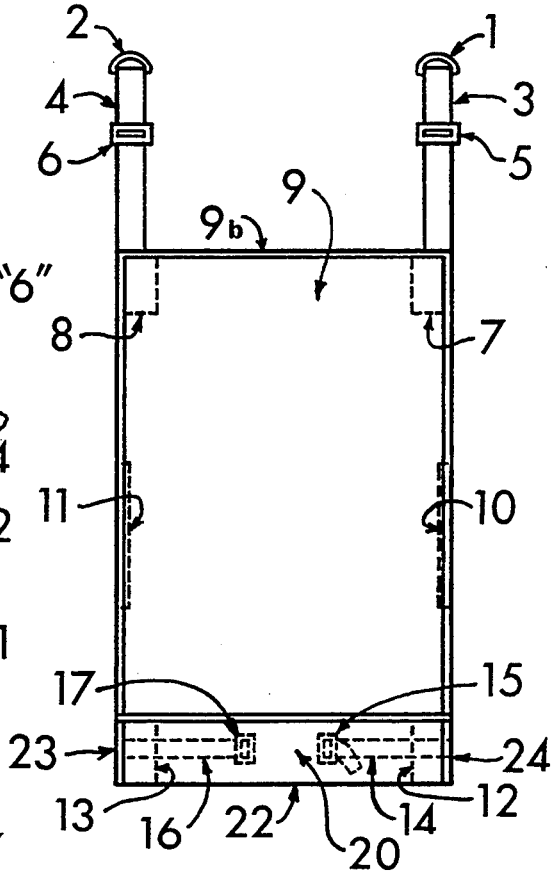
FIG. 5 is a back view in elevation of the ski seat and ski carrier of this invention.
Figure 4:
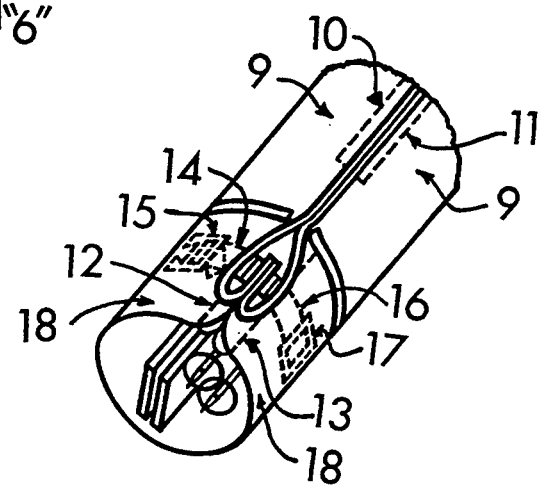
FIG. 4 is a partial view in perspective of the ski seat and ski carrier with the seat panel wrapped up around the skier's skis and poles, showing its use as a ski carrier.
Figure 6:
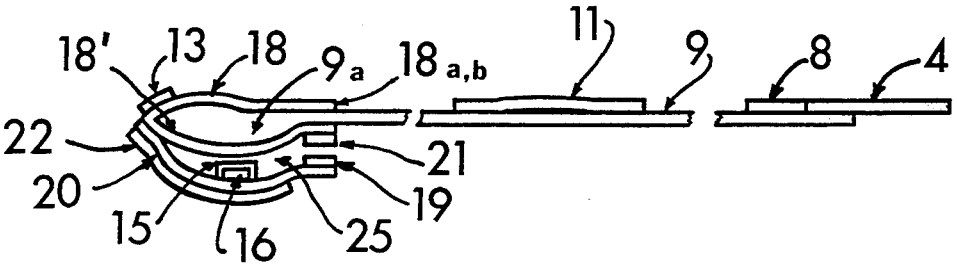
FIG. 6 is a side view of the ski seat and ski carrier of this invention, that would be similar to a view taken along the line 6—6 of FIG. 3.

Referring initially to FIGS. 1–6, the ski seat and ski carrier of this invention comprises a seat panel 9 that is designed to be suspended between two skis by a pair of ski tip attachment means. Seat panel 9 is generally rectangular in plan view; but its top end, for example, may be curved somewhat. These attachment means comprise, at the upper left of the panel (as viewed from the front of the panel), a support strap 3 that may be lengthened and shortened by a buckle 5 and a ski-engaging D-ring 1; and at the upper right of the panel, a support strap 4 that may be lengthened and shortened by a buckle 6 and a ski-engaging D-ring 2. Straps 3 and 4 are preferably fabricated from 2 inch wide Nylon webbing. D-rings 1 and 2 and slider buckles 4 and 5 are preferably fabricated from plastic. Each strap 3, 4 is preferably fastened to the upper left or right edge of panel 9 as by sewing. Each strap 3, 4 extends outward from its sewn end, loops through its respective D-ring 1, 2 and is fastened at its outer end to its slider buckle 4, 5. The slider buckles 4, 5 ride on their respective straps so that the effective length between the strap sewn ends and their D-rings can be lengthened and shortened. At the bottom of panel 9, bottom attachment means provides a transverse slot *9a* through which a ski pole may be inserted, the ends of the ski pole extending beyond the panel 9 for placement across the tops of part of the skis' bindings. The combined length of straps 3 and 4 and panel 9 is greater than the distance between the ski tips and the top of the ski bindings, and thus, the panel 9 provides a sling-type seat as shown in FIG. 2. The bottom attachment means is preferably provided by folding the material from which panel 9 is fabricated back on itself, as at 18, 18' as shown in FIG. 6. The bottom edge 18*b* of this material, now lapped back on the material, is preferably stitched to the underlaying material along a transverse line as at 18*a*, to provide the slot 9*a*. The bottom end 18*b* of the material, from which panel 9 is provided, could be folded over so that the exposed end would lay on the front side of panel 9, as shown in FIG. 6, or it could be folded under so that the exposed end would lay on the back side of panel 9. The sections 18, 18' are not stitched at their sides, so that slot 9*a* is open at both ends. Panel 9 is preferably fabricated from a light weight, but durable, Nylon mesh fabric, and is preferably about 2 feet wide and 3 feet long. This fabric would preferably be bound at its peripheral edges with a selvage material. Slot 9*a* is preferably about 4½ inches wide. Panel 9, then, extends from an upper end 9*b* to the bottom end of section 18, at 22, as shown in FIG. 5. Thus, section 18 is part of panel 9.

A pocket panel 20 is provided of about the same length and width as the panel sections 18, 18' that is about 4½ inches wide by about 2 feet long. Panel 20 is preferably fabricated of the same material as panel 9. Panel 20 is fastened to the bottom edge of one of the panel sections, section 18' as at 22, preferably by stitching and is fastened at its side edges to section 18', as at 23, 24, thereby providing a pocket 25 that is stitched closed on the bottom and on both ends. A pair of VELCRO fastener strips 19, 21 are fastened, as by stitching, to section 18' and to panel 20 as shown in FIG. 6. One strip of the pair, 19 or 21, is a pile strip and the other is a hook strip. These pair of VELCRO fastener strips extend across the length of the panel 20 and are positioned adjacent the opening to pocket 25 as shown. When the VELCRO fastener strips, 19, 21, are fastened together, pocket 25 is closed, and conversely, when the strips 19, 21 are separated, pocket 25 is opened.

On the back side of panel 9 (as seen in FIG. 5 in dotted line) four VELCRO fastener patches, 7, 8 12, 13, are fastened, as by stitching, one being located at each corner of panel 9. Of the VELCRO fastener pair of patches 7, 8 one would be a VELCRO fastener hook patch and the other would be a VELCRO fastener pile patch, each preferably about 2 inches wide and 4 inches long. Of the VELCRO fastener pair of patches 12, 13, one would be a VELCRO fastener hook patch and the other would be a VELCRO fastener pile patch, each preferably about 2 inches wide and 4 inches long. Patches 12, 13 are stitched to the back face of pocket panel 20. When panel 9 is laid out flat with its back side upward as shown in FIG. 5, the panel 9 may be folded about its longitudinal axis to bring the VELCRO fastener patch pairs, 7–8 and 12–13, together, thereby forming, when the VELCRO fastener patch pairs are fastened, an elongated channel (see FIG. 4) in which a skier's skis and poles may be carried. A pair of handle straps 10, 11 are fastened, as by stitching, at the midpoint of the sides of panel 9 to enable the skier to carry this elongated channel by the handle straps.

Waist straps 14, 16 are fastened to the ends 23, 24 of pocket 25 as by stitching. Side-release buckle halves, 15, 17, are attached to the ends of straps 14, 16. These straps and buckle halves are contained within pocket 25, as shown in FIGS. 5 and 6, when the ski seat and ski carrier of this invention is deployed as either a ski seat or as a ski carrier. Each strap is preferably about 12 inches long and 1½ inches wide.

Figure 7:
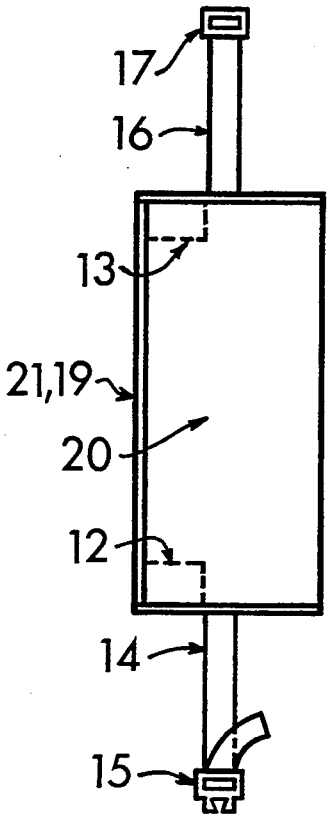
FIG. 7 is a view of the ski seat and ski carrier of this invention folded into an integral storage compartment and ready for strapping around a skier's waist for transport as a skier's waist pack.
Figure 8:
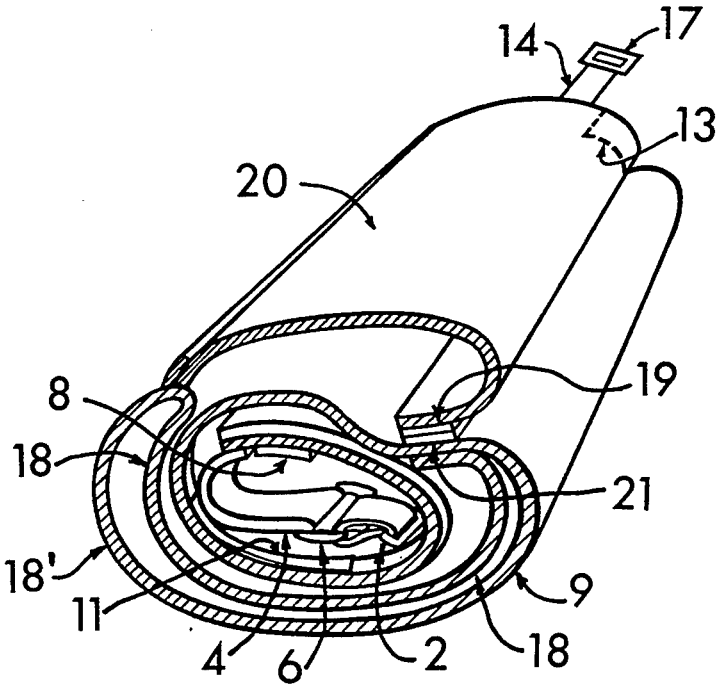
FIG. 8 is a partially cut-away view in perspective of the ski seat and ski carrier of this invention as it would appear when folded into its integral storage compartment and thereby converted into a skier's waist pack.

When it is desired to stow the ski seat and ski carrier of this invention, or to fold it up for carrying around the skier's waist, the following procedure is employed. Viewing FIG. 6, support straps 3 and 4 are folded back onto the panel 9. Then panel 9 is folded, beginning at the top end 9*b*, onto itself in approximately 4 inch sections, with the last folding bringing the folded sections to rest on top of section 18. Pocket 25 is then opened by separating the VELCRO fastener strips 19, 21, and pocket 25 is turned inside out. By turning pocket 25 inside out, panel section 20 is reversed and now overlays the folded-up sections of panel 9, and section 18' is exposed and becomes the underside of the assembly. This arrangement, with pocket 25 turned inside out, is shown in FIG. 8. Then, the edge of panel 20 that carries VELCRO fastener strip 19 is doubled over to bring strip 19 back into face-to-face juxtaposition with VELCRO fastener strip 21, as shown also in FIG. 8. When strips 19 and 21 are fastened together, the pocket 25 is again closed with the folded-up panel 9 contained therein. Now, waist straps 14, 16 and buckle halves 15, 17 are exposed and can be wrapped around the skier's waist so that the assembly can be carried around the skier's waist. This arrangement is shown in FIG. 7.

While the preferred embodiment of the invention has been described herein, variations in the design may be made. The scope of the invention, therefore, is only to be limited by the claims appended hereto.

The embodiments of the invention in which an exclusive property is claimed are defined as follows:

I claim:

1. In a ski seat and carrier comprising a generally rectangular seat panel having a top and a bottom and a length and a width, means at the top of said seat panel for attaching said seat panel to a pair of skis for suspending said seat panel between the pair of skis, and means at the bottom of said seat panel for receiving a ski pole for suspending the bottom of said seat panel between the pair of skis whereby said seat panel can provide a sling-type seat for a skier when suspended between the pair of skis, an improvement comprising in combination:

means providing a pocket extending across the bottom of said seat panel, said pocket having a closed bottom end and closed side ends and providing a compartment having a depth substantially less than the length of said seat panel and a width extending substantially across the width of said seat panel, and said pocket having an opening extending substantially across the width of said seat panel so that said compartment opens toward the end of said seat panel that is opposite the seat panel's bottom end;

the means providing said pocket being so constructed and arranged with respect to said seat panel that, when said seat panel is folded onto itself into a series of transverse folds, said compartment may be turned inside out to envelope the folded seat panel.

2. The ski seat and carrier of claim 1 wherein said means providing said pocket includes a pair of hook and loop fastener strips, one a pile strip and the other a hook strip, secured, respectively, to said panel and to said means providing said pocket for closing said compartment, said hook and loop fastener strips being so constructed and arranged that, when said folded seat panel is contained within said compartment, said hook and loop fastener strips may be fastened together to close said compartment about said seat panel.

3. The seat and carrier of claim 1 wherein said means providing said pocket includes strap means secured within said compartment, said strap means being so constructed and arranged that such means is exposed when said compartment is turned inside out whereby said means providing said pocket may be strapped to skier's waist when said panel is contained within said compartment.

4. The ski seat and carrier of claim 1 wherein said seat panel has four corners; and including fastener means provided at each of the seat panel's four corners, said fastener means being so constructed and arranged that, when said seat panel is folded longitudinally, the top and bottom corners of said seat panel can be fastened together to provide an elongated channel within which a skier's skis and pole may be carried; and including handle means attached to said seat panel for carrying a said seat panel when folded and fastened for carrying a skier's skis and poles.

5. In a ski seat and carrier comprising a generally rectangular seat panel having a top and a bottom and a length and a width, means at the top of said seat panel for attaching said seat panel to a pair of skis for suspending said seat panel between the pair of skis, and means at the bottom of said seat panel for receiving a ski pole for suspending the bottom of said seat panel between the pair of skis whereby said seat panel can provide a sling-type seat for a skier when suspended between the pair, of skis, an improvement comprising in combination:

means providing a pocket extending across the bottom of said seat panel, said pocket having a closed bottom end and closed side ends and providing a compartment having a depth substantially less than the length of said seat panel and a width extending substantially across the width of said seat panel, and said pocket having an opening extending substantially across the width of said seat panel so that said compartment opens toward the end of said seat panel that is opposite the seat panel's bottom end;

the means providing said pocket being so constructed and arranged with respect to said seat panel that, when said seat panel is folded onto itself into a series of transverse folds, said compartment may be turned inside out to envelope the folded seat panel;

said means providing said pocket including a pair of hook and loop fastener strips, one a pile strip and the other a hook strip, secured, respectively, to said panel and to said means providing said pocket for closing said compartment, said hook and loop fastener strips being so constructed and arranged that, when said folded seat panel is contained within said compartment, said hook and loop fastener strips may be fastened together to close said compartment about said seat panel; and said means providing said pocket including strap means secured within said compartment, said strap means being so constructed and arranged that such means is exposed when said compartment is turned inside out whereby said means providing said pocket may be strapped to a skier's waist when said panel is contained within said compartment.

* * * * *